United States Patent [19]

Yoder

[11] 3,941,964

[45] Mar. 2, 1976

[54] PUSH-BUTTON TYPE BINARY SWITCH DEVICE

[75] Inventor: Alan C. Yoder, Fort Wayne, Ind.

[73] Assignee: Bowmar Instrument Corporation, Fort Wayne, Ind.

[22] Filed: Dec. 9, 1974

[21] Appl. No.: 530,744

[52] U.S. Cl. ..... 200/159 A; 200/5 A; 200/275

[51] Int. Cl.[2] ..... H01H 3/12

[58] Field of Search .... 200/5 R, 5 A, 159 A, 159 B, 200/275

[56] References Cited

UNITED STATES PATENTS

| | | | |
|---|---|---|---|
| 3,641,286 | 2/1972 | Berezowski | 200/5 A |
| 3,796,843 | 3/1974 | Durkee et al. | 200/5 A |

*Primary Examiner*—Robert K. Schaefer
*Assistant Examiner*—M. Ginsburg

[57] ABSTRACT

A push-button type switch device for use in generating binary coded signals. An insulative board is provided having flat opposite surfaces. An overcenter, snap-acting diaphragm switch element is provided movable between a first inactive position and a second overcenter operative position in response to application of a predetermined operating force thereon, as by depression of a push button. The diaphragm element has a centrally disposed common contact area and a plurality of radially spaced leg members extending outwardly therefrom. The leg members have outer ends which respectively engage first terminal pads on one surface of the board thereby normally supporting the diaphragm element thereon in its first position. A common terminal is provided on the one side of the board and has an external conductor connected thereto, the common terminal being in registry with the common contact area of the diaphragm element and spaced therefrom in the first position. The common contact area engages the common terminal in the second position of the diaphragm element. The leg members have portions thereon inwardly from the outer ends which are respectively in registry with and spaced from other terminal pads on the one surface of the board in the first position of the diaphragm element. At least one preselected terminal pad has an external conductor connected thereto. The diaphragm element is proportioned and arranged so that the leg member portions engage their respective other terminal pads in a third position of the diaphragm element which is intermediate the first and second positions and prior to engagement of the common contact area with the common terminal.

12 Claims, 9 Drawing Figures

FIG. 3
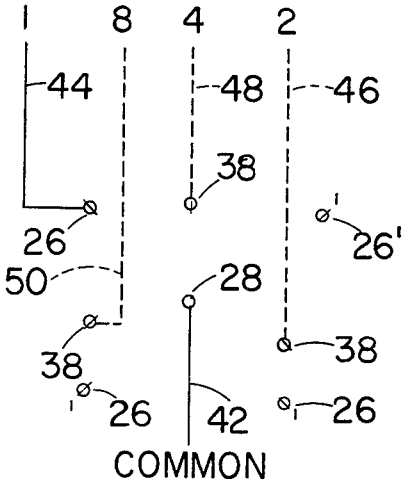
FIG. 4
| NO. | LINE | | | |
|---|---|---|---|---|
| | 8 | 4 | 2 | 1 |
| 0 | O | O | O | O |
| 1 | O | O | O | C |
| 2 | O | O | C | O |
| 3 | O | O | C | C |
| 4 | O | C | O | O |
| 5 | O | C | O | C |
| 6 | O | C | C | O |
| 7 | O | C | C | C |
| 8 | C | O | O | O |
| 9 | C | O | O | C |
| 10 | C | O | C | O |
| 11 | C | O | C | C |
| 12 | C | C | O | O |
| 13 | C | C | O | C |
| 14 | C | C | C | O |
| 15 | C | C | C | C |
| 16 | O | O | O | O |
| 17 | O | O | O | C |
FIG. 7
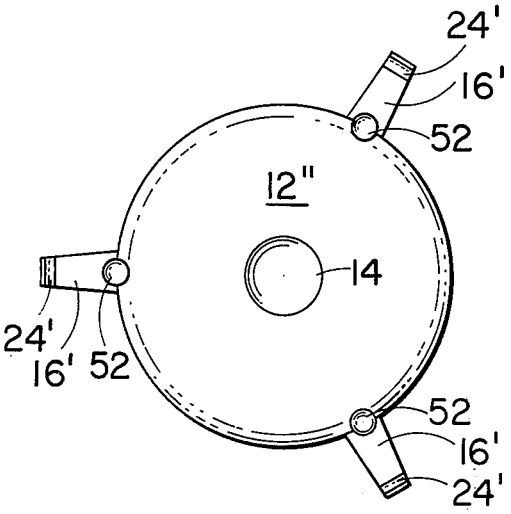
FIG. 8
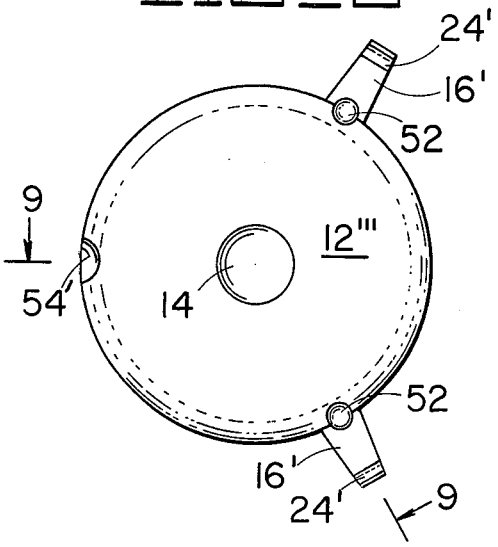
FIG. 9
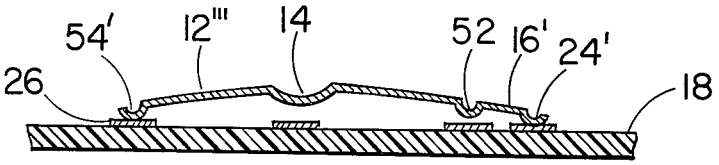

PUSH-BUTTON TYPE BINARY SWITCH DEVICE

BACKGROUND OF THE INVENTION

1. Field of the Invention

This invention relates generally to binary switches and more particularly to a push button type binary switch device.

2. Description of the Prior Art

Binary switches are employed for generating preselected binary coded signals for use in digitally controlled and data processing apparatus. The most common type of binary switch is a rotary switch often provided in thumb wheel-actuated form. Such prior binary switches have been characterized by their complexity and relatively high cost. U.S. Pat. No. 3,796,843 assigned to the Assignee of the present application discloses a keyboard switch assembly employing an overcenter, snap-acting diaphragm switch element and a singlesided printed circuit board.

SUMMARY OF THE INVENTION

It is desirable to provide a push-button type switch device capable of generating binary coded signals. A plurality of such binary switches may be assembled in a keyboard resembling a calculator keyboard or push-button telephone dial thus permitting selection of the desired binary coded signals by pushing the appropriate pushbuttons.

The invention, in its broader aspects, provides a push-button type switch device for use in generating binary coded signals and comprises an insulative board having flat opposite surfaces and an overcenter, snap-acting diaphragm switch element movable between a first inactive position and a second overcenter operative position in response to application of a predetermined operating force thereon, as by a pushbutton. The diaphragm element has a centrally disposed common contact area and a plurality of radially spaced leg members extending outwardly therefrom. At least some of the leg members respectively engage first terminal pads on one surface of the insulative board and normally support the diaphragm element thereon in its first position. A common terminal on the one surface of the board has an external conductor connected thereto, the common terminal being in registry with the common contact area of the diaphragm element and spaced therefrom in the first position thereof. The common contact area engages the common terminal in the second position of the diaphragm element. Certain of the leg members have portions respectively in registry with and spaced from other terminal pads on the one surface of the board in the first position of the diaphragm element. At least one preselected terminal pad has another external conductor connected thereto, the number of terminal pads to which external conductors are connected providing the desired binary coded signal upon actuation of the diaphragm element. The diaphragm element is proportioned and arranged so that the leg member portions engage their respective other terminal pads in a third position of the element intermediate the first and second positions and prior to engagement of the common contact area with the common terminal.

It is accordingly an object of the invention to provide an improved binary switch device.

Another object of the invention is to provide a push-button type switch device for use in generating binary coded signals.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 3 is a schematic view showing different connections to provide binary coded signals with the switch device of the invention;

FIG. 4 shows a binary code which may be provided by the various permutations of the switch device of the invention;

FIG. 7 is a fragmentary top view showing a modification of the embodiment of FIG. 5;

FIG. 8 is a fragmentary top view showing another modification of the embodiment of FIG. 5; and FIG. 9 is a fragmentary cross-sectional view taken generally along the line 9—9 of FIG. 8.

DESCRIPTION OF THE PREFERRED EMBODIMENTS

Figure 1:
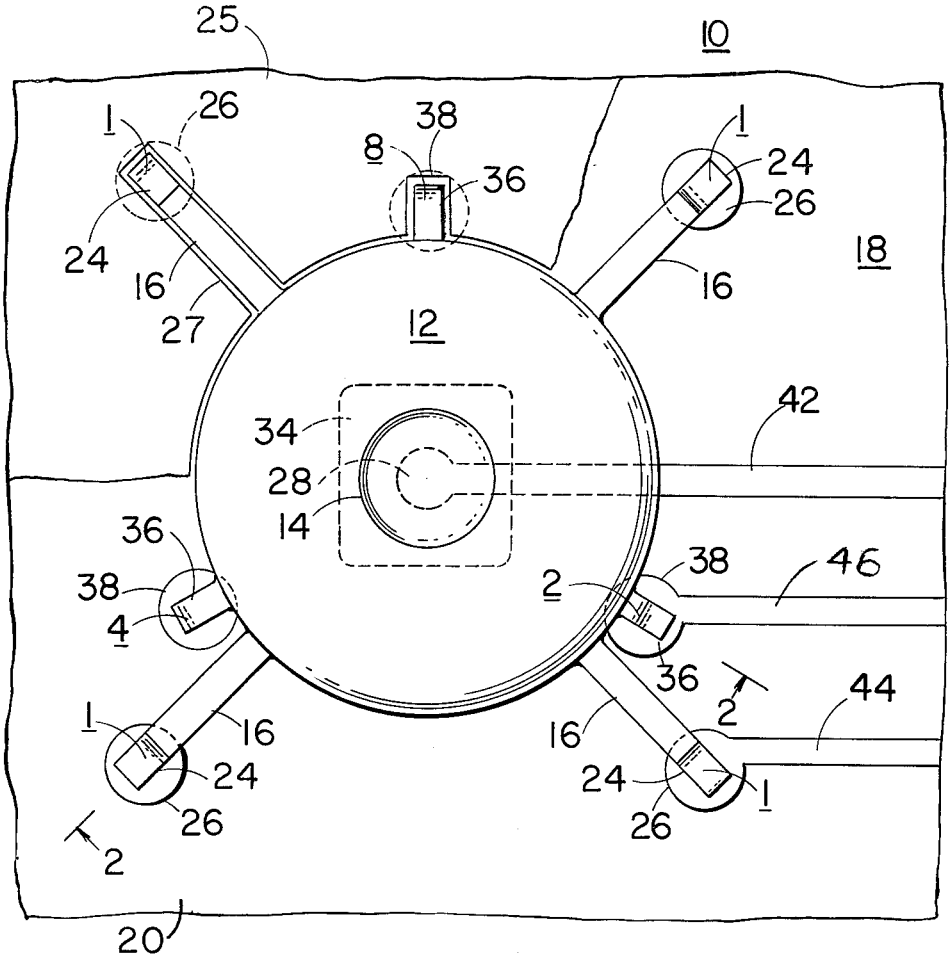
FIG. 1 is a top view showing one embodiment of the push-button type switch device of the invention.
Figure 2:
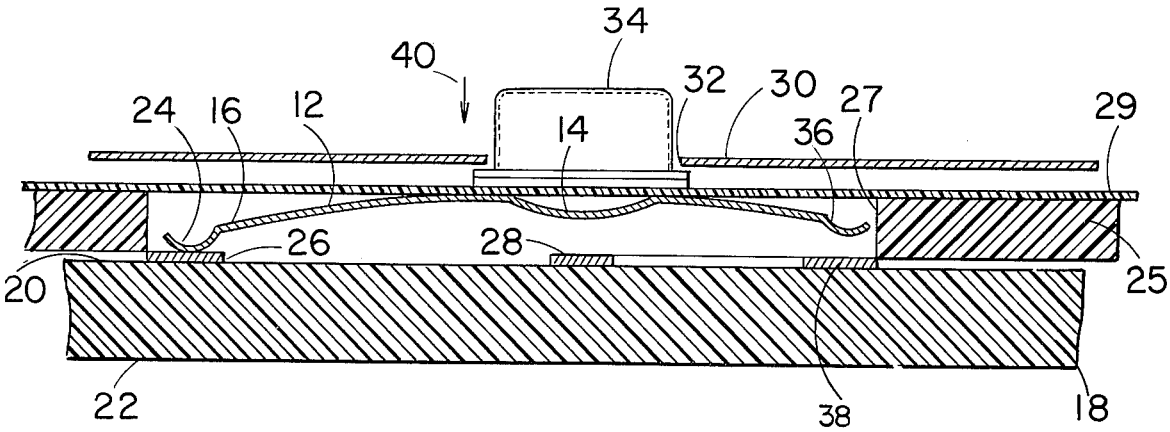
FIG. 2 is a cross-sectional view taken generally along the line 2—2 of FIG. 1.

Referring now to FIGS. 1 and 2 of the drawings, the improved binary switch device of the invention, generally indicated at 10, comprises an overcenter, snap-acting, "oilcan", diaphragm switch element 12 having a center contact dimple 14. Diaphragm element 12 has four equally-radially spaced apart, outward extending leg members 16 formed thereon.

An insulative board 18 is provided having flat opposite surfaces 20 and 22. Outer ends 24 of leg members 16 respectively engage terminal pads 26 on top surface 20 of board 18 and support diaphragm element 12 in a first, inactive position with center dimple 14 spaced from common terminal pad 28 on surface 20 of board 18, as shown in FIG. 2. Insulative retainer member 25 covers surface 20 of board 18 and the terminal pads and conductors thereon and has cut-out portion 27 therein which receives and locates switch element 12. Thin insulative sheet 29 covers retainer member 25 and switch element 12, as further shown and described in the aforesaid U.S. Pat. No. 3,796,843.

Escutcheon plate 30 is provided having opening 32 therein which receives and locates push button 34. Push button 34 is adapted to apply a downward force to diaphragm element 12 as will hereinafter be described.

Three equally-radially spaced relatively short leg members or feet 36 extend outwardly from diaphragm element 12 and are respectively in registry with terminal pads 38 on side 20 of board 18. Feet 36 are respectively spaced from terminal pads 38 in the first position of diaphragm element 12, as shown in FIG. 2.

Upon application of a predetermined force on push button 34, as shown by arrow 40, diaphragm element 12 is moved to a second, operative position with center contact dimple 14 engaging common terminal pad 28 and with feet 36 engaging terminal pads 38. In accordance with the invention, diaphragm element 12 and leg members 16 are proportioned and arranged so that diaphragm element 12 passes through a third, intermediate position in which feet 36 engage terminal pads 38 prior to engagement of center contact dimple 14 with common terminal pad 28.

Common external conductor 42 on surface 20 of board 18 is connected to common terminal pad 28. In order to provide a desired binary signal output, external conductors are connected to preselected ones of the remaining terminal pads, such as conductor 44 connected to terminal pad 26 and conductor 46 connected to terminal pad 38 which provides a binary coded signal corresponding to the numeral three as shown in FIG. 4.

Referring now to FIGS. 3 and 4, it will be seen that common external conductor 42 is, in each switch configuration, connected to common terminal pad 28. The connection of external conductors to the remaining terminal pads 26, 38 depends on the binary coded signal to be provided upon actuation of the switch element. Thus, as shown in FIG. 4, and referring to an 8421 binary code, external conductor 46 may be connected to terminal pad 38 and external conductor 44 may be connected to terminal pad 26 to provide a binary coded signal corresponding to the digital numeral three. Likewise, external conductor 48 may be connected to the "four" terminal pad 38 and external conductor 50 may be connected to the "eight" terminal pad 38 in accordance with the table shown in FIG. 4 to provide, for example, binary coded signals corresponding to the digits zero through sixteen.

It will now be seen that ends 24 of leg members 16 are in contact with terminal pads 26 on printed circuit board 18 in the first, at-rest or released position of the device. As load is applied by push button 34 to the center dimple 14, the leg members 16 and diaphragm element 12 deflect, the force at the dimple increasing to a maximum and then starting to decrease. At this point, the diaphragm element or dome 12 will snap-over and the feet 36 and center dimple 14 come in contact with their respective terminal pads 28, 38 on printed circuit board 18. As the load is released, the force at the center dimple 14 will decrease to a point where the diaphragm element or dome 14 will snap-back and the center dimple 14 and feet 36 will break contact with the printed circuit board 18. As previously stated, it is important that the center contact dimple 14 make contact last with feet 36 making contact prior to that time, and that the center contact dimple 14 be the first to break contact upon release.

Figure 5:
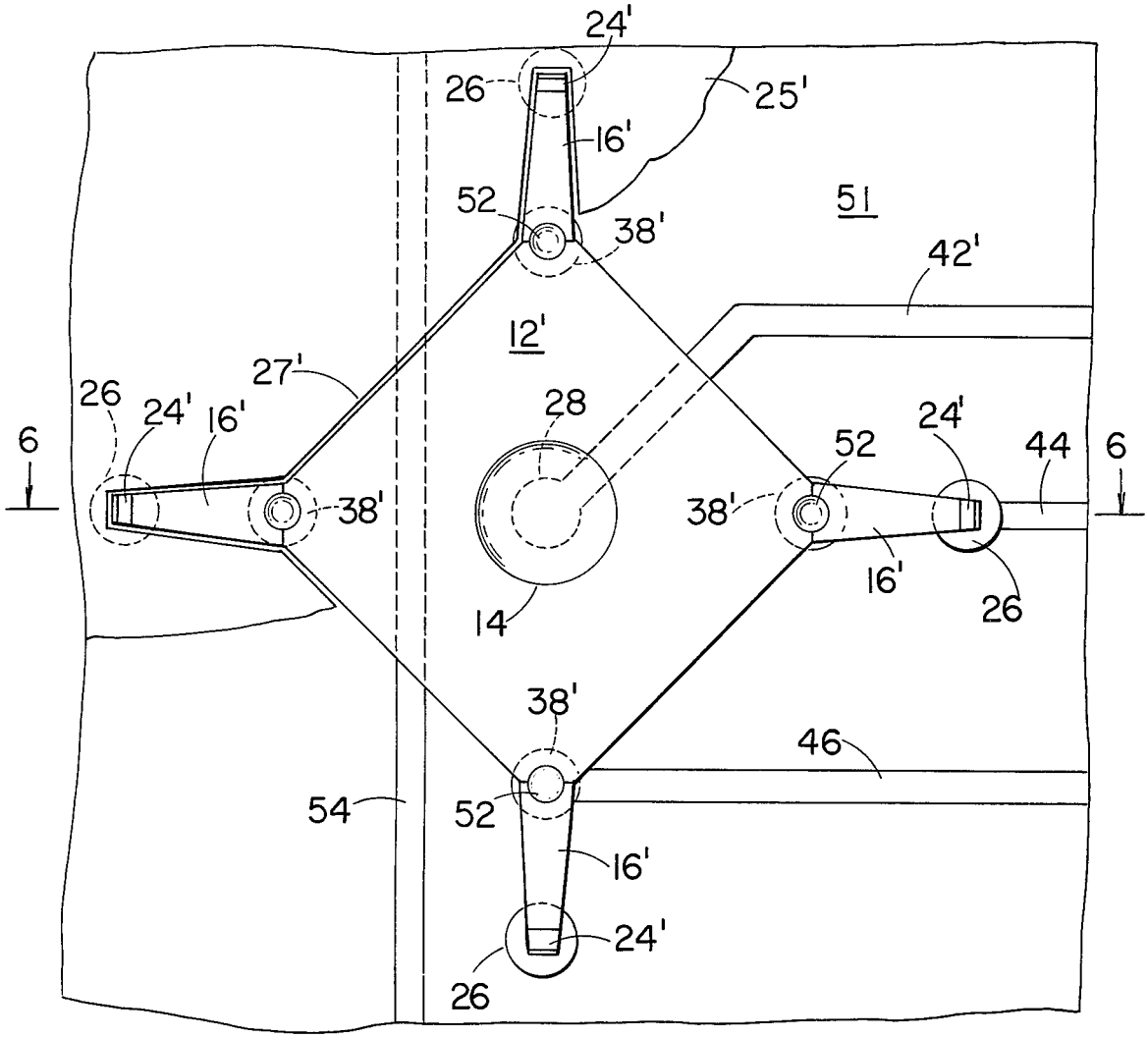
FIG. 5 is a top view showing the preferred embodiment of the invention.
Figure 6:
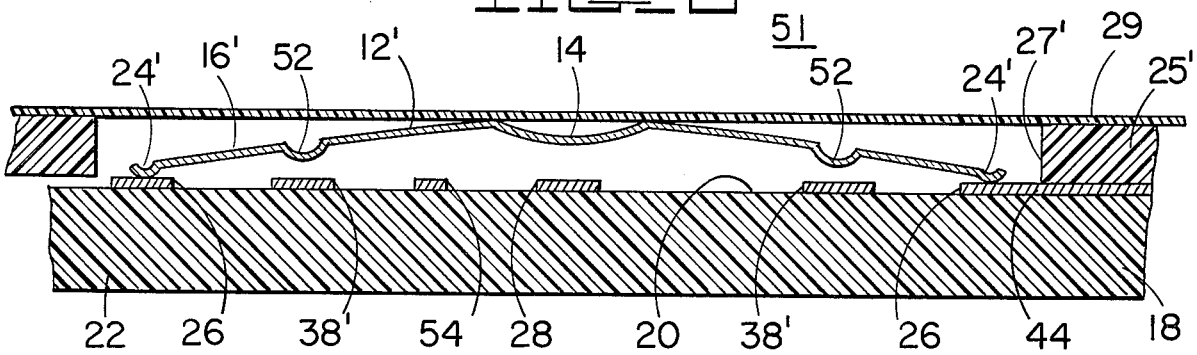
FIG. 6 is a cross-section view taken generally along the line 6—6 of FIG. 5.

Referring now to FIGS. 5 and 6 in which like elements are indicated by like reference numerals and similar elements by primed reference numbers, there is shown the preferred embodiment of the invention generally indicated at 51. Here, overcenter, snap-acting, "oilcan", diaphragm switch element 12' has four equally-spaced apart, outwardly extending leg members 16' formed thereon and contact dimple 14 at the center thereof. Outer ends 24' of leg members 16' respectively engage terminal pads 26 on top surface 20 of insulative board 18 and support diaphragm element 12' in its first, inactive position with center dimple 14 spaced from common terminal pad 28 on surface 20 of board 18, as shown in FIG. 6.

Insulative retainer member 25' covers surface 20 of board 18 and the terminal pads and conductors thereon and has cut-out portion 27' therein which receives and locates switch element 12'. Thin insulative sheet 29 covers retainer member 25' and switch element 12'.

Here, contact dimples 52 are formed in switch element 12' respectively adjacent the junctions of leg members 16' therewith, contact dimples 52 being respectively in registry with terminal pads 38' on side 20 of board 18 and respectively spaced therefrom in the first position of diaphragm element 12' as best seen in FIG. 6.

Upon application of a predetermined force on push-button 34 (FIG. 1), diaphragm element 12' is moved to a second, operative position with center contact dimple 14 engaging common terminal pad 28 and with contact dimple 52 respectively engaging terminal pads 38'. It will be readily apparent that in this embodiment, contact dimples 52 engage terminal pads 38 prior to engagement of center contact dimple 14 with common terminal pad 28.

As in the case of the previous embodiment, common external terminal 42' on surface 20 of board 18 is connected to common terminal pad 28 and, in order to provide the desired binary signal output, external conductors are connected to preselected ones of the remaining terminal pads, such as conductor 44 connected to terminal pad 26 and conductor 46 connected to terminal pad 38.

As in the case of the construction shown in the aforesaid U.S. Pat. No. 3,796,843, the design of switch element 12, 12' is such that it is possible to route other conductors, such as conductor 54, on top surface 20 of board 18 under switching element 12, 12'.

Referring now to FIG. 7 in which like elements are again indicated by like reference numerals and similar elements by double primed reference numerals, diaphragm switching element 12'' may be provided with only three leg members 16' as shown in FIG. 7, or may have more than four leg members 16'.

Referring now to FIGS. 8 and 9 in which like elements are again indicated by like reference numerals and similar elements by triple primed reference numerals, diaphragm switch element 12''' may have only two leg members 16' with the remaining engagement with a terminal pad 26 being provided by contact dimple 54 at the peripheral edge of element 12'''. It will thus be seen that in this manner the three-leg embodiment shown in FIG. 7 may be provided with one leg missing, and that the four-leg embodiment of FIG. 5 may be provided with two legs missing. It will further be seen that the three-leg embodiment of FIG. 7 may in the same fashion be provided with only one leg member 16'.

Referring again to the embodiment shown in FIGS. 1 and 2, while ends 24 of leg members 16 have been shown and described as being at all times in engagement with terminal pads 26, depending upon the spring rate of the leg members 16 and the relative height dimensions of ends 24, feet 36 and center contact dimple 14, it is possible to produce a device in which ends 24 will lift off and be spaced from their respective terminal pads 26 when switch element 12 is moved to its second, operative position. This construction adds a normally closed or double throw feature to the switching possibilities of the device.

While there have been described above the principles of this invention in connection with specific apparatus, it is to be clearly understood that this description is made only by way of example and not as a limitation to the scope of the invention.

What is claimed is:

1. A push-button type switch device for use in generating binary coded signals comprising an insulative board having flat opposite surfaces, and an overcenter, snap-acting diaphragm switch member movable between a first inactive position and a second overcenter operative position in response to application of a predetermined operating force thereon, said member having a centrally disposed common contact area, said switch member having a plurality of radially spaced contact elements formed on the periphery thereof, at least some of said contact elements respectively engaging first terminal pads on one surface of said board and normally supporting said member thereon in said first position, a common terminal on said one surface of said board and having an external conductor connected thereto, said common terminal being in registry with said common contact area and spaced therefrom in said first position, at least one of said contact elements having a portion respectively in registry with and spaced from another terminal pad on said one surface of said board in said first position of said member, at least one preselected terminal pad having another external conductor connected thereto, said member being proportioned and arranged so that said contact element portion engages said other terminal pad in a third position of said member intermediate said first and second positions and prior to engagement of said common contact area with said common terminal.

2. The device of claim 1 wherein at least one of said contact elements is a leg member extending outwardly from said periphery of said switch member and having an outer end engaging a first terminal pad.

3. The device of claim 2 wherein said portion is formed on said leg member inwardly from said outer end thereof.

4. The device of claim 1 wherein said contact elements are leg members extending outwardly from said periphery of said switch member.

5. The device of claim 4 wherein there are a plurality of other terminal pads, there being first and second groups of said leg members, all of said first group engaging first terminal pads and supporting said switch member thereon, all of said second group having said portions thereon and being respectively in registry with said other terminal pads.

6. The device of claim 5 wherein said first group of leg members are respectively longer than said second group.

7. The device of claim 6 wherein the outer ends of said first group of leg members engage respectively said first terminal pads, the outer ends of said second group of leg members comprising said portions and being respectively in registry with said other terminal pads.

8. The device of claim 7 wherein there are four of said first group of leg members and three of said second group.

9. The device of claim 7 wherein said common contact area disengages said common terminal upon release of said force prior to disengagement of said portions of said second group of leg members from said other terminal pads.

10. The device of claim 5 wherein all of said leg members have outer ends which respectively engage said first terminal pads, all of said leg members having said portions respectively formed thereon inwardly from said outer ends.

11. The device of claim 10 wherein said leg member portions are formed thereon adjacent the junctions of said leg members with said switch member.

12. The device of claim 10 wherein said switch member has another contact area formed at the periphery thereof and spaced from said leg members, said other contact area engaging a terminal pad on said one surface of said board and supporting said member thereon in said first position.

* * * * *